US006532905B2

(12) United States Patent
Belin et al.

(10) Patent No.: US 6,532,905 B2
(45) Date of Patent: Mar. 18, 2003

(54) CFB WITH CONTROLLABLE IN-BED HEAT EXCHANGER

(75) Inventors: Felix Belin, Brecksville, OH (US); Mikhail Maryamchik, Copley Township, Summit County, OH (US); Sundara M. Kavidass, Uniontown, OH (US); David J. Walker, Wadsworth, OH (US); Donald L. Wietzke, Carlsbad, CA (US)

(73) Assignee: The Babcock & Wilcox Company, New Orleans, LA (US)

( * ) Notice: Subject to any disclaimer, the term of this patent is extended or adjusted under 35 U.S.C. 154(b) by 0 days.

(21) Appl. No.: 09/906,993

(22) Filed: Jul. 17, 2001

(65) Prior Publication Data

US 2003/0015150 A1 Jan. 23, 2003

(51) Int. Cl.[7] ..... F28D 13/00
(52) U.S. Cl. ..... 122/4 D; 165/104.16; 110/245
(58) Field of Search ..... 122/4 D; 165/104.16; 110/245

(56) References Cited

U.S. PATENT DOCUMENTS 4,969,930 A * 11/1990 Arpalahti ..... 122/4 D
6,230,664 B1 * 5/2001 Janka et al. ..... 122/4 D

* cited by examiner

*Primary Examiner*—Gregory Wilson
(74) *Attorney, Agent, or Firm*—Eric Marich

(57) ABSTRACT

A circulating fluidized bed (CFB) boiler has one or more bubbling fluidized bed enclosures containing heating surfaces and located within a lower portion of the CFB boiler to provide a compact, efficient design with a reduced footprint area. The heating surfaces are provided within the bubbling fluidized bed located above a CFB grid and/or in a moving packed bed below the CFB grid inside the lower portion of the CFB boiler. Solids in the bubbling fluidized bed are maintained in a slow bubbling fluidized bed state by separately controlled fluidization gas supplies. Separately controlled fluidization gas is used to control bed level in the bubbling fluidized beds or to control the throughput of solids through the bubbling fluidized beds. Solids ejected from the bubbling fluidized beds can be returned directly into the surrounding CFB environment of the CFB boiler, or purged from the system for disposal or recycle back into the CFB. Solids which are recycled back to the CFB have less heat and can be used to control the temperature of the fast moving bed in the CFB.

24 Claims, 5 Drawing Sheets

CFB WITH CONTROLLABLE IN-BED HEAT EXCHANGER

FIELD AND BACKGROUND OF THE INVENTION

The present invention relates generally to the field of circulating fluidized bed (CFB) reactors or boilers such as those used in electric power generation facilities and, in particular, to a new and useful CFB reactor arrangement which permits temperature control within the CFB reaction chamber and/or of the effluent solids. The CFB reactor arrangement according to the invention contains and supports not only the CFB but also one or more bubbling fluidized bed(s) (BFB's) in a lower portion of the CFB reactor enclosure; i.e., one or more slow bubbling bed region(s) are maintained and located within a fast CFB region. An arrangement of heating surface is located within the bubbling fluidized bed(s) (BFB's). Heat transfer to the heating surface is controlled by providing separately controlled fluidizing gas to the bubbling fluidized bed(s) (BFB's) to either maintain a desired bed level or control a throughput of solids through the bubbling fluidized bed(s) (BFB's).

Most prior arts bubbling bed heat exchangers known to the inventors are located outside of the CFB reaction chamber and occupy at least one of the enclosure walls.

For example, U.S. Pat. Nos. 5,526,775 and 5,533,471 to Hyppänen each disclose a CFB having an adjacent bubbling fluidized bed with an integral heat exchanger. U.S. Pat. No. 5,533,471 teaches placing the slow bubbling fluidized bed below and to the side of the bottom of the faster moving CFB chamber. In U.S. Pat. No. 5,526,775, the slow bubbling bed is above and to the side of the fast CFB. Each of the slow beds is controlled by permitting particles to escape back into the main CFB chamber from an opening in the side of the slow bed chamber. These heat exchangers further require a different gas distribution grid level for each bed, which substantially complicates the structure of the CFB systems. The plan area of the CFB can be increased as a result.

Other patents disclose heat exchanger elements located above the grid of a CFB furnace, but not within a slow bubbling bed region of a fast CFB. U.S. Pat. No. 5,190,451 to Goldbach, for example, illustrates a CFB chamber having a heat exchanger immersed within a fluidized bed at the lower end of the chamber. The bed has only one air injector for controlling the circulation rate for the entire bed.

U.S. Pat. No. 5,299,532 to Dietz discloses a CFB having a recycle chamber immediately adjacent the main CFB chamber. The recycle chamber receives partially combusted particulate from a cyclone separator connected between the recycle chamber and the upper exhaust of the main CFB chamber. A heat exchanger is provided inside the recycle chamber, and the recycle chamber is separated from the main CFB chamber by water walls and occupies part of the lower portion of the furnace enclosure; the recycle chamber does not extend outwardly from the furnace enclosure.

U.S. Pat. No. 5,184,671 to Alliston et al. teaches a heat exchanger having multiple fluidized bed regions. One region has heat exchange surfaces, while the other regions are used to control the rate of heat transfer between the fluidized bed material and the heat exchanger surfaces.

None of these prior art bubbling beds is incorporated in a manner which simplifies the overall construction of the CFB reactor and permits easy access to enclosure walls for feeding reagents, maintenance and inspections.

SUMMARY OF THE INVENTION

The present invention seeks to overcome the limitations of the prior art CFB slow bed heat exchangers by providing a CFB boiler or reactor having an internal heat exchanger in a slow bubbling bed, and without increasing the plan area of the CFB.

Accordingly, one aspect of the present invention is drawn to a circulating fluidized bed (CFB) boiler, comprising: a CFB reaction chamber having side walls and a grid defining a floor at a lower end of the CFB reaction chamber for providing fluidizing gas into the CFB reaction chamber. Means are provided for supplying an amount of fluidizing gas to a first portion of the grid sufficient to produce a fast moving bed of fluidized solids in a first zone of the CFB reaction chamber, and for providing an amount of fluidizing gas to a second portion of the grid sufficient to produce a bubbling fluidized bed of fluidized solids in a second zone of the CFB reaction chamber. The amount of fluidizing gas provided to one zone is controllable independently of the amount of fluidizing gas provided to the other zone. Finally, means are provided for removing solids from the first and second zones for purging the solids from or recycling the solids to the CFB boiler to control the fast moving bed.

Thus, the CFB boiler is partitioned into two portions: a first portion or zone which is operated as a fast moving circulating fluidized bed, and a second region or zone which is operated as a slow bubbling fluidized bed.

The slow bubbling bed height is controlled within the range corresponding to the height of its enclosure walls. Mechanisms for controlling the slow bed height include outlets through the top of the enclosure and a valved outlet through the bottom side edges of the enclosure.

In an alternate embodiment, a portion of the floor-level grid has openings sufficient to allow particles to fall through. A heat exchanger is located directly below the main CFB chamber. A secondary fluidizing gas supply is provided in the region of the grid above the heat exchanger. The amount of particles falling through into the area below the grid with the slow bubbling bed can be controlled by controlling their purge or recycle rate.

In a further embodiment, the above-grid enclosure for one heat exchanger is combined with the below-grid position of a second heat exchanger.

The improved CFB design of the invention permits a reduced footprint size of the CFB and allows the enclosure walls to be straightened. The design is simpler in construction and provides easier access to the enclosure walls for feeding reagents.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

As used herein, the term CFB boiler will be used to refer to CFB reactors or combustors wherein a combustion process takes place. While the present invention is directed particularly to boilers or steam generators which employ CFB combustors as the means by which the heat is produced, it is understood that the present invention can readily be employed in a different kind of CFB reactor. For example, the invention could be applied in a reactor that is employed for chemical reactions other than a combustion process, or where a gas/solids mixture from a combustion process occurring elsewhere is provided to the reactor for further processing, or where the reactor merely provides an enclosure wherein particles or solids are entrained in a gas that is not necessarily a byproduct of a combustion process.

Figure 1:
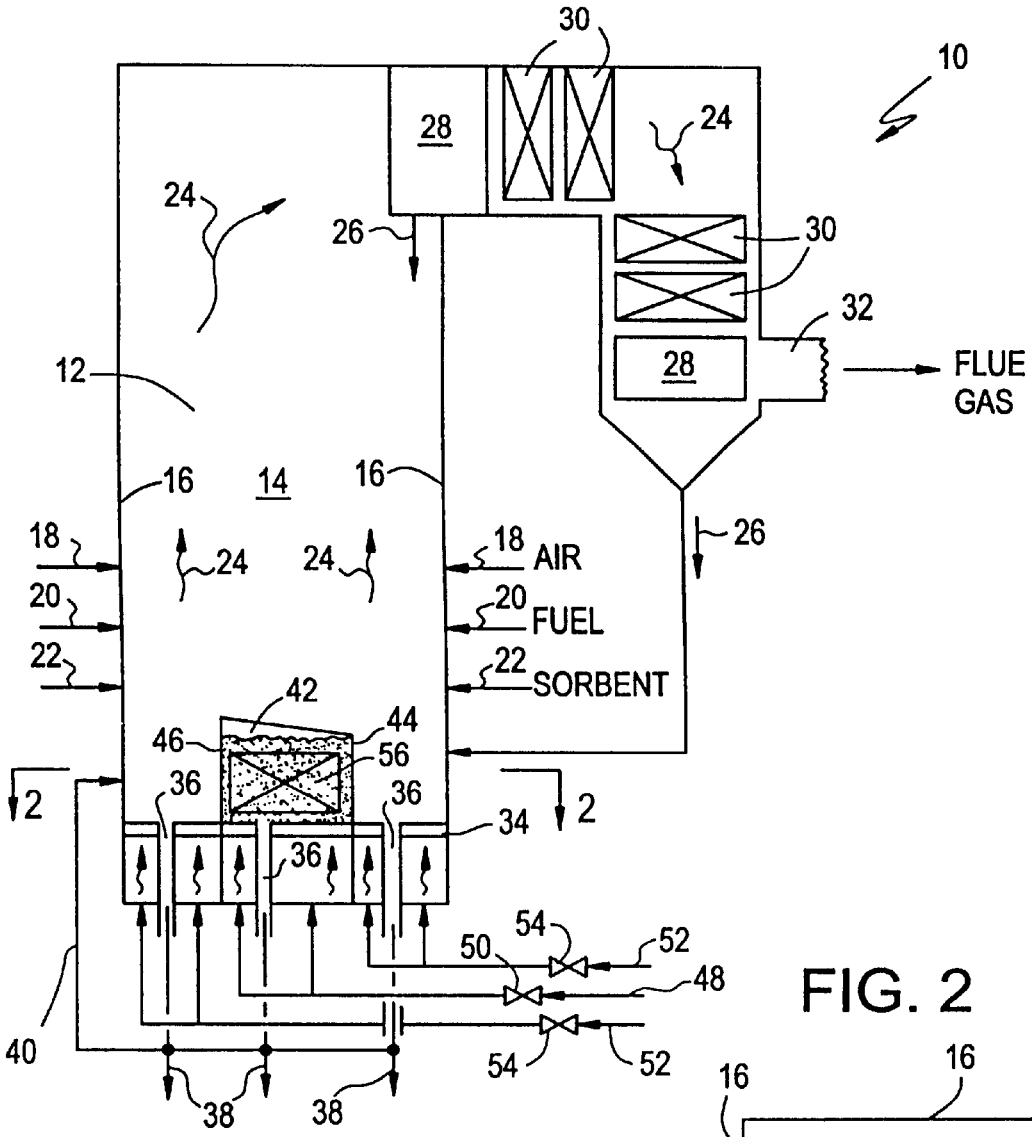
FIG. 1 is a sectional side elevational view of a CFB boiler according to a first embodiment of the invention, illustrating a bubbling fluidized bed (BFB) enclosure within the CFB boiler.

Referring now to the drawings, wherein like reference numerals designate the same or functionally similar elements throughout the several drawings, and to FIG. 1 in particular, there is illustrated a circulating fluidized bed (CFB) reactor or boiler, generally referred to as CFB boiler 10. The CFB boiler 10 has a reactor or reaction chamber or furnace enclosure 12 containing a circulating fluidized bed 14. As is known to those skilled in the art, the furnace enclosure 12 is typically rectangular in cross-section and comprises fluid cooled membrane tube enclosure walls 16 typically comprised of water and/or steam conveying tubes separated from one another by a steel membrane to achieve a gas-tight reactor enclosure 12.

Air 18, fuel 20 and sorbent 22 are provided into a lower portion of the furnace 12 and react in a combustion process to produce hot flue gas and entrained particles 24 which pass up through the furnace 12 reactor. The hot flue gases and entrained particles 24 are then conveyed through several cleaning and heat removal stages, 28, 30, respectively, before the hot flue gases are conveyed to an exhaust flue 32 as shown. Collected particles 26 are returned to the lower portion of the furnace where further combustion or reaction can occur.

The lower portion of the furnace 12 is provided with a fluidization gas distribution grid 34 (advantageously a perforated plate or the like provided with a multiplicity of bubble caps (not shown)) up through which fluidizing gas (typically air) is provided under pressure to fluidize the bed of fuel 20, sorbent 22, collected solids particles 26, and recycled solids particles 40 (described infra) which had been purged from the system. Any additional air needed for complete combustion of the fuel 20 is advantageously provided through the enclosure walls 16 as shown at 18. The fast moving CFB 14 is thus created above the distribution grid 34, with solids particles moving rapidly within and through the flue gases resulting from the combustion process.

Although the CFB 14 features a vigorous circulation of entrained solids, some of these solids cannot be supported by the upward gas flow from grid 34 and thus fall back toward the grid 34, while others continue upward through the furnace 12 as described earlier. Some solids particles are removed from the lower portion of the furnace 12 via bed drains 36 and may be purged from the system as shown at 38, or recycled as shown at 40. The flow of solids removed via the bed drains 36 may be controlled in any known manner, such as with mechanical rotary valves or screws, or air-assisted conveyors or valves, or combinations thereof. In any event, it will be appreciated that the lower portion of the furnace 12 is exposed to an intensive downfall of solids particles.

According to the present invention, in its simplest form, a bubbling fluidized bed (BFB) enclosure 42 having enclosure walls 44 is provided above the grid 34 within the furnace 12 in the lower portion thereof, and contains a bubbling fluidized bed (BFB) 46 during operation of the CFB boiler 10. The enclosure walls 44 separate the bubbling fluidized bed (BFB) 46 from the CFB 14. The bubbling fluidized bed (BFB) 46 is created by separately supplying and controlling fluidizing gas to it up through the grid 34; that is, separate from that portion of the fluidizing gas provided up through the grid 34 which establishes the CFB 14. The CFB boiler 10 is thus partitioned into two general types of regions or zones above the grid, wherein the zones are created by providing and controlling different amounts of fluidizing gas through the grid into each zone. The first zone, of course, is the main circulating fluidized bed (CFB) zone, while the second zone is a bubbling fluidized bed (BFB) region or zone 46 which is contained within the CFB zone 14.

As illustrated in FIG. 1, the fluidizing gas provided to the bubbling fluidized bed (BFB) 46 is designated 48, and controlled by valve or control means schematically indicated at 50. The fluidizing gas provided to establish the CFB 14 is designated 52, and is controlled by valve or control means schematically indicated at 54.

Located within the bubbling fluidized bed (BFB) enclosure 42 is an arrangement of heating surface 56 which absorbs heat from the bubbling fluidized bed (BFB) 46. The heating surface 56 may advantageously be superheater, reheater, economizer, evaporative (boiler), or combinations of such types of heating surface which are known to those skilled in the art. The heating surface 56 is typically a serpentine arrangement of tubes which convey a heat transfer medium therethrough, such as water, a two-phase mixture of water and steam, or steam. While the overall furnace 12 operates in a CFB mode, the bubbling fluidized bed (BFB) 46 is operated and controlled as such by separately controlling, as at 50, the amount of fluidizing gas 48 provided up through that portion of the grid 34 beneath the bubbling fluidized bed (BFB) enclosure 42. Downfalling solids particles 24 from the CFB 14 within the lower portion of the furnace 12 feed the bubbling fluidized bed (BFB) 46.

Figure 2:
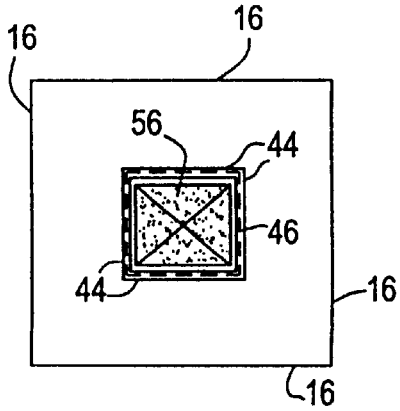
FIG. 2 is a sectional plan view of the CFB boiler of FIG. 1, viewed in the direction of arrows 2—2.

The enclosure walls 44 of the bubbling fluidized bed (BFB) enclosure 42 may all be the same height or different, and vertical, sloped or a combination thereof. The top of the bubbling fluidized bed (BFB) enclosure 42 may be inclined or substantially horizontal and, if necessary, may be partially covered. However, it will be appreciated that the maximum level or height of the bubbling fluidized bed (BFB) 46 within the enclosure 42 is limited by the height of the shortest enclosure wall 44 of the enclosure 42. As illustrated in FIG. 2, one preferred location of the bubbling fluidized bed (BFB) enclosure 42 is in a central portion of the furnace 12. However, as illustrated in FIGS. 9–14, infra, other locations for the bubbling fluidized bed (BFB) enclosure 42 within a lower portion of the furnace 12 are also acceptable.

An important aspect of the present invention is that the bubbling fluidized bed (BFB) 46 may be controlled to control the heat transfer to the heating surface 56 located within the bubbling fluidized bed (BFB) 46. This can be accomplished by either controlling the level of the solids within the bubbling fluidized bed (BFB) 46, or by controlling the throughput of solids across the heating surface 56 located within the bubbling fluidized bed (BFB) 46.

Figure 3:
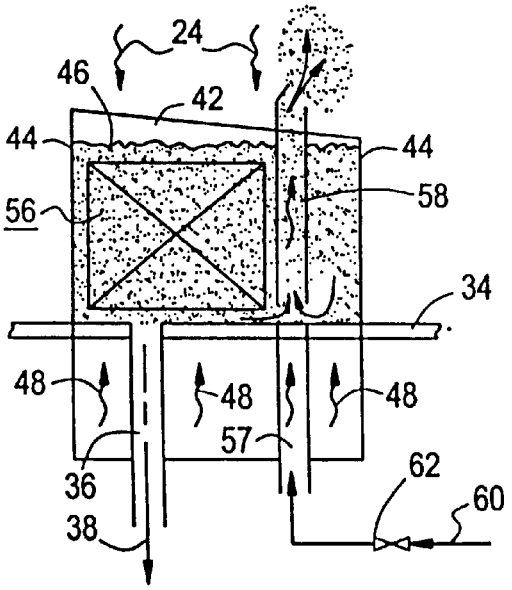
FIG. 3 is a partial sectional side elevational view of a CFB boiler according to a second embodiment of the invention illustrating removal of solids from the bubbling fluidized bed (BFB) enclosure via one or more internal conduits.

FIG. 3 illustrates one optional means for controlling the heat transfer within the bubbling fluidized bed (BFB) 46, which comprises provision of one or more conduits 58 extending from a lower part of the bed 46 just above the grid 34 to an upper level at or above the lowest portion of the walls 44, and the conduit(s) 58 may have any general configuration which satisfies this criteria. Below each of the conduit(s) 58 there is provided a gas conduit 57 and separate fluidizing means which introduces fluidizing gas 60 controlled via valve means 62. By fluidizing the solids particles in the conduit(s) 58 located directly above the gas conduit 57, their upward movement through the conduit(s) 58 is promoted, causing the solids particles to be discharged from the bubbling fluidized bed (BFB) 46 into the surrounding CFB 14. When the fluidizing gas 60 rate is increased, or additional conduits 58 are put into operation, the overall solids discharge from the bubbling fluidized bed (BFB) 46 will eventually exceed the solids influx into the bed 46 from the CFB 14, causing the bed level to decrease. The more the solids discharge from the bed 46 exceeds the solids influx from the CFB 14, the lower the bed level will become.

Figure 4:
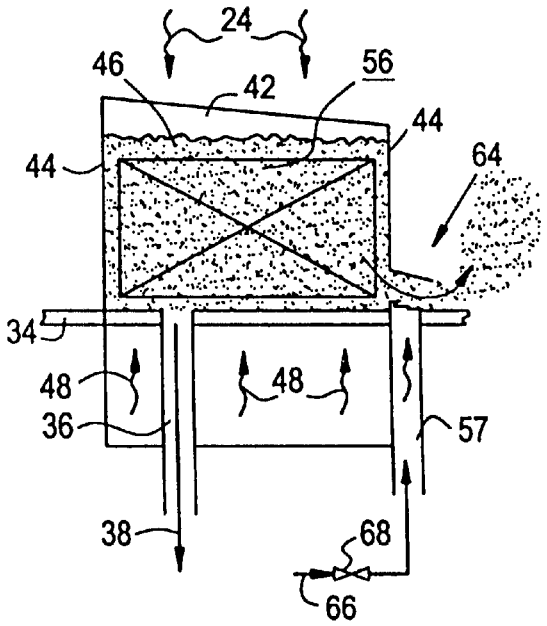
FIG. 4 is a partial sectional side elevational view of a CFB boiler according to a third embodiment of the invention illustrating removal of solids from the bubbling fluidized bed (BFB) enclosure via one or more non-mechanical valves.

FIG. 4 illustrates another means for controlling the heat transfer within the bubbling fluidized bed (BFB) 46 which involves provision of one or more non-mechanical valve(s) 64 each with its own controlled gas supply 66 controlled via gas conduit 57 and valve means 68. Gas flow to the vicinity of the valve(s) 64 promotes solids discharge from the lower part of the bubbling fluidized bed (BFB) 46 into the CFB 14. Again, by controlling the gas flow rate and/or the number of valve(s) 64 in operation, the bubbling fluidized bed (BFB) level can be controlled in a manner similar to that described above.

When the overall solids discharge is lower than the solids influx, the bed 46 level is constant, being determined by the height of the lowest enclosure wall 44. In this situation, increasing the solids discharge from the lower part of the bed 46 (via either of the approaches of FIGS. 3 or 4) will cause an increased supply of "fresh" influx solids from the upper portion of the bed 46 to the heating surface 56. This will intensify the heat transfer between the bed 46 and the heating surface 56. If the discharge rate from the bed 46 is increased further, the bed level will decrease, thereby reducing the area of heating surface 56 immersed in the bed 46 solids. Since the heat transfer rate for non-immersed portions of heating surface is significantly lower than for immersed portions, the overall heat transfer rate to the heating surface, and its heat transfer medium being conveyed therethrough, will decrease. This provides an operator of the CFB boiler 10 with increased operational flexibility, since overall heat transfer can be controlled in different modes-with a constant or variable bed 46 level-as dictated by operational requirements or convenience.

When heat is transferred from the solids to the heating surface 56, the solids temperature in the bubbling fluidized bed (BFB) 46 will differ from that in the CFB 14. When a solids purge from the lower part of the CFB boiler 10 is required, it may be beneficial to discharge these solids from the bubbling fluidized bed (BFB) 46, since purging cooled bottom ash from a CFB furnace 12 reduces the sensible heat loss that would otherwise occur if hotter solids were purged.

Figure 5:
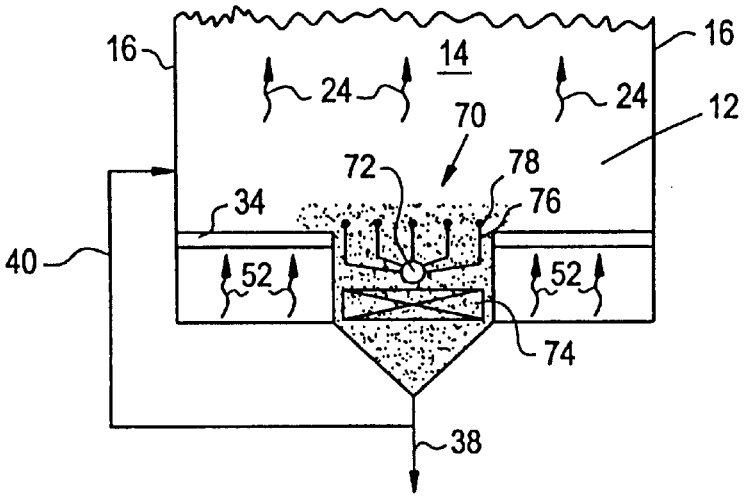
FIG. 5 is a partial sectional side elevational view of a CFB boiler according to a fourth embodiment of the invention illustrating placement of heating surface below an arrangement of air supply tubes located below an upper surface of a grid level of the CFB boiler.

FIG. 5 illustrates another way of implementing the invention. In this embodiment, the lower portion of the CFB furnace 12 again has a fluidization grid 34 with its own fluidizing gas supply 52. However, one or more portions 70 of the grid 34 is provided with its own, separately controlled gas supply 72. Portion 70 of the grid has an arrangement of air supply tubes 76 provided with bubble caps 78 spaced from one another to provide openings sufficient for bed solids particles to fall downwardly through the grid. In one aspect of the present invention, these particles fall across a heating surface 74 located in the vicinity of the grid 34 but below the upper surface of the grid 34 level. In this configuration, the heating surface 74 is well suited to the task of cooling the discharged solids prior to purging (as described above) or recycling them back into the CFB boiler 10.

Figure 6:
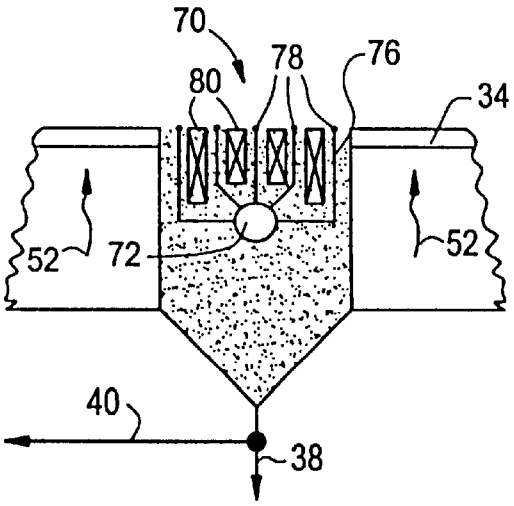
FIG. 6 is a partial sectional side elevational view of a CFB boiler according to a fifth embodiment of the invention illustrating placement of heating surface within an arrangement of air supply tubes located below an upper surface of a grid level of the CFB boiler.
Figure 7:
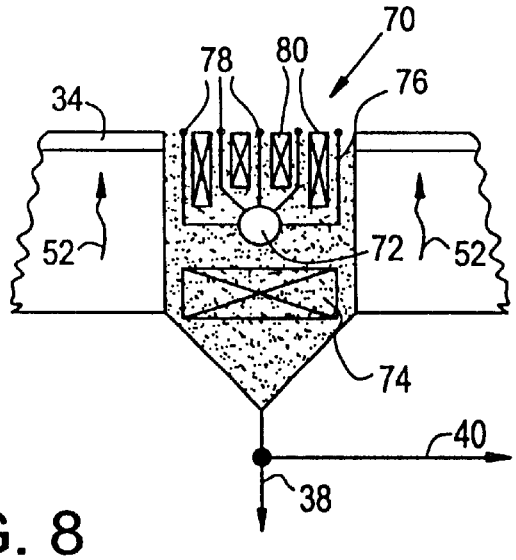
FIG. 7 is a partial sectional side elevational view of a CFB boiler according to a sixth embodiment of the invention illustrating placement of heating surface both within and below an arrangement of air supply tubes located below an upper surface of a grid level of the CFB boiler.

Solids particles traveling downwardly will pass across the heating surface 74 resulting in heat transfer between the solids particles and the heating surface 74. Again, the overall heat transfer can be controlled by controlling solids flow rate across the heating surface 74; solids can then be purged or recycled back to the CFB 14 as before. Such purge and recycle flows can be handled by known means such as mechanical devices, e.g., a rotary valve or a screw, or non-mechanical devices, e.g., an air-assisted conveyor or valve, or a combination of mechanical and non-mechanical devices. FIGS. 6 and 7 illustrate other variations in the placement of the heating surface 74 below the grid level. In FIG. 6, heating surface 80 is located interspersed inbetween the air supply tubes of portion 70, while in FIG. 7, the heating surface 74 is located below the air supply tubes of portion 70 while an additional heating surface 80 is located interspersed inbetween the air supply tubes of portion 70.

By developing a way to place the bubbling fluidized bed (BFB) enclosure 42 with the heating surface 74, 80 within the CFB chamber 12, as opposed to being offset to the sides outside of the CFB boiler 10, the overall footprint, or plan area of the CFB boiler 10 is reduced. Further, the CFB chamber 12 may have straight side walls 16, which reduces maintenance and erosion, while providing easier access to the enclosure walls 16 for feeding reagents to the combustion process, installing additional structure and performing maintenance. Straight furnace enclosure walls 16 can be used when the total area of the grid 34 occupied by the bubbling fluidized bed (BFB) enclosure 42 and the balance of the CFB grid 34 is selected to be equal to the plan area of the upper part of the CFB chamber 12. The required upward gas velocity can still be achieved in the lower part in such case.

Figure 8:
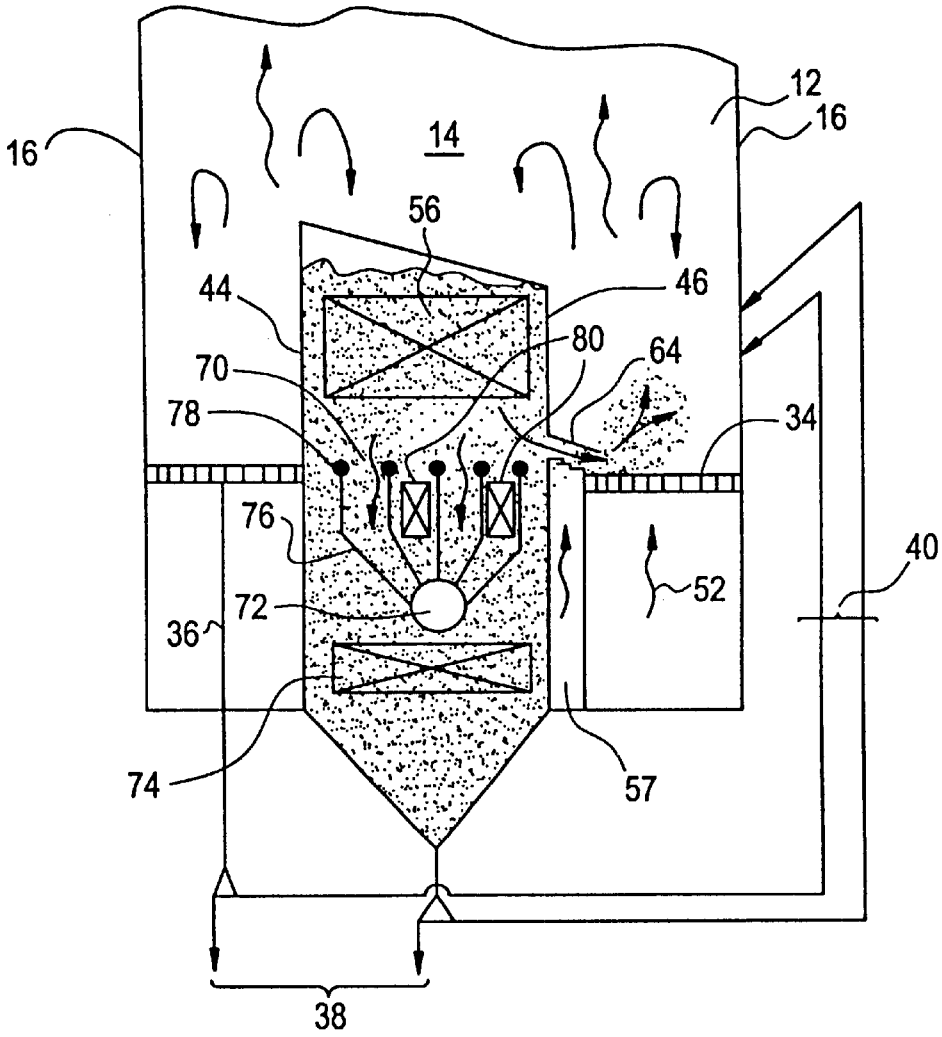
FIG. 8 is a partial sectional side elevational view of a CFB boiler illustrating the application of several principles of the invention.
Figure 9:
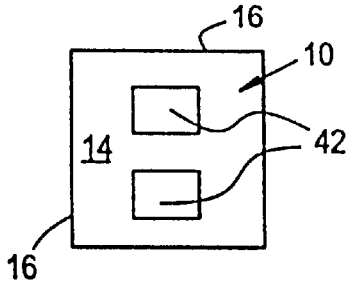
FIGS. 9–14 are top plan views of alternate locations or positions inside the CFB boiler of the bubbling fluidized bed (BFB) enclosures which contain the heating surfaces according to the invention.
Figure 10:
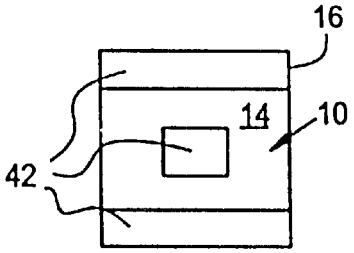
Figure 11:
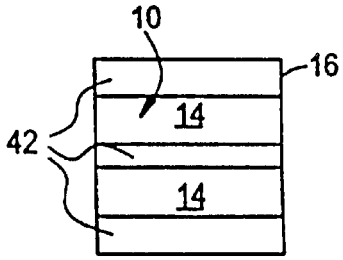
Figure 12:
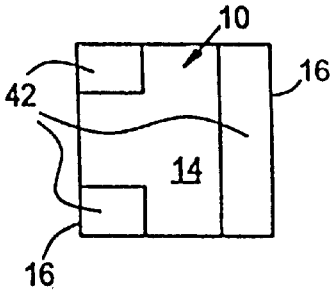
Figure 13:
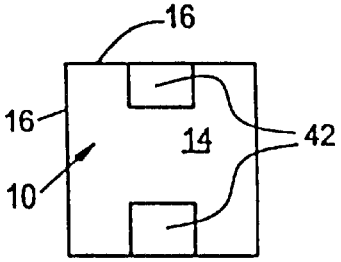
Figure 14:
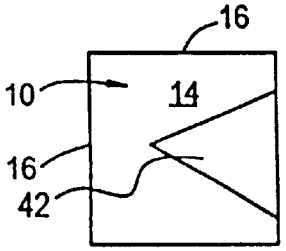

FIG. 8 is a partial sectional side elevational view of a CFB boiler illustrating the application of several principles of the invention. As shown, heating surface 56, located above the grid 34, and heating surface 74 located below the air supply tubes 76 may be provided. Heating surface 80, as before, could also be included if desired. In this embodiment, means for controlling the heat transfer within the bubbling fluidized bed (BFB) 46 involves provision of the one or more non-mechanical valve(s) 64 each with its own controlled gas supply 66 (not shown) controlled via gas conduit 57 and valve means 68 (not shown).

While to this point each of the embodiments has illustrated the bubbling fluidized bed (BFB) enclosure 42 as being substantially in the center of the CFB chamber 12, the one or more bubbling fluidized bed (BFB) enclosure(s) 42 may be located in different positions within the CFB boiler, as illustrated in FIGS. 9–14. FIGS. 9–14 each illustrate different locations in the CFB boiler 10 where one or more bubbling fluidized bed (BFB) enclosures 42 can be located. As seen in each case, the enclosure 42 is located entirely within the furnace enclosure walls 16 of the CFB chamber 12, thereby providing a reduced plan area of the CFB boiler 10. Regardless of the particular location within the CFB boiler 10, the bubbling fluidized bed (BFB) enclosures 42 can be used as described above to control the operation of the CFB 10 in an effective manner while reducing the footprint space needed for the CFB boiler 10.

Figure 15:
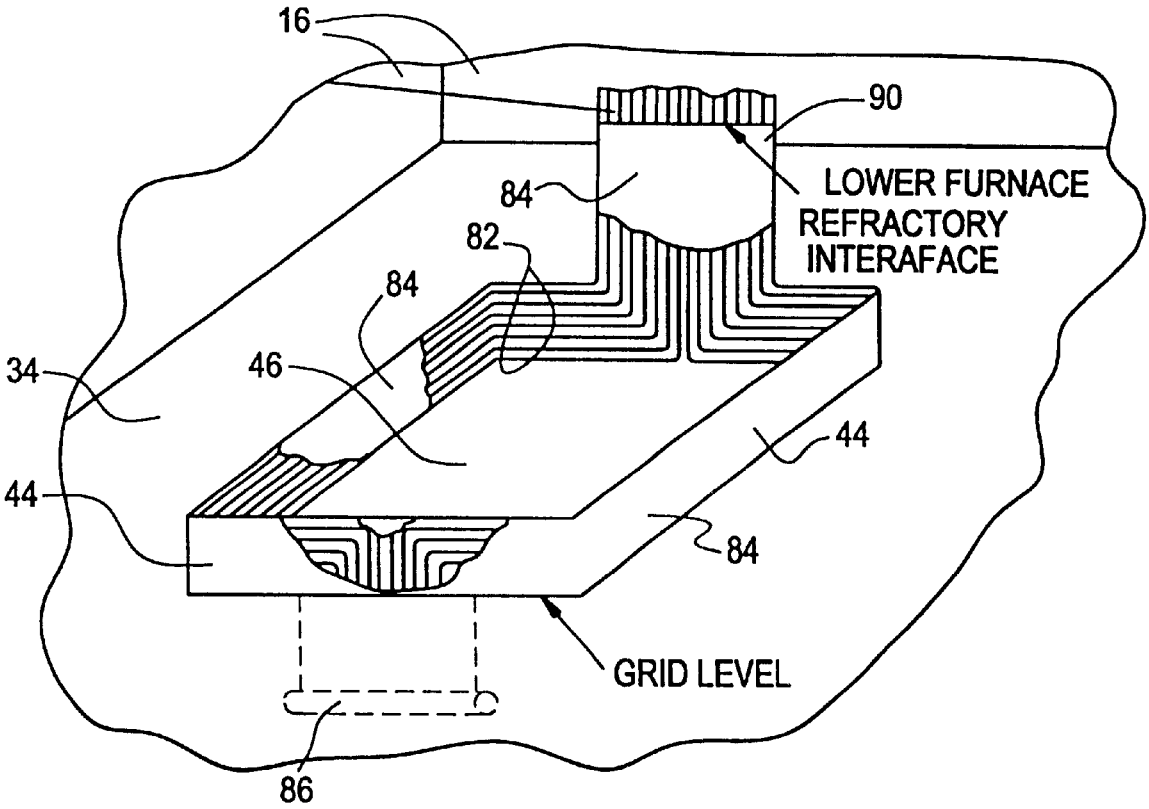
FIG. 15 is a perspective view of a lower portion of the CFB boiler illustrating one form of the construction of the bubbling fluidized bed (BFB) enclosure.

The enclosure walls 44 forming the bubbling fluidized bed (BFB) enclosure 42 may be constructed in several ways. Preferably, the enclosure walls 44 would be comprised of fluid cooled tubes covered with erosion resistant material such as brick or refractory to prevent erosion of the tubes during operation. FIG. 15 is a perspective view of a lower portion of the CFB chamber 12 illustrating one form of the construction of the bubbling fluidized bed (BFB) enclosure 42, and which is particularly suited for an enclosure 42 which is not adjacent to any of the furnace enclosure walls 16. The walls 44 are made of fluid cooled tubes 82 covered with brick or refractory 84. Inlet or outlet headers may be provided as required to provide or collect the fluid conveyed through the tubes 82 in known fashion. In FIG. 15, for example, an inlet header 86 may be provided underneath the grid 34, and which supplies the tubes 82. After encircling the bubbling fluidized bed (BFB) enclosure 42, the tubes 82 then form a division wall 90 which could extend throughout the entire height (not shown in FIG. 15) of the CFB furnace 12, terminating at an upper outlet header (also not shown) above a roof of the furnace 12.

Figure 16:
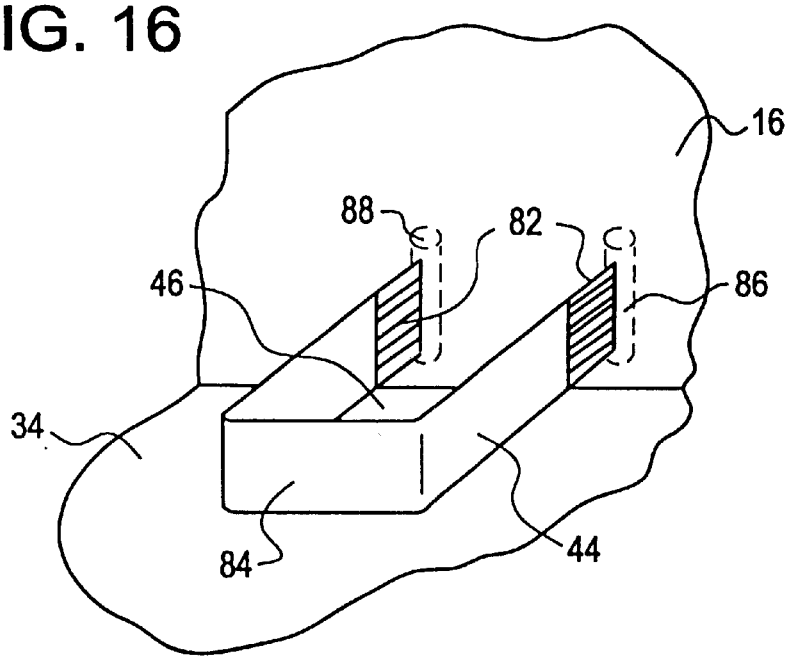
FIG. 16 is another perspective view of a lower portion of the CFB boiler illustrating another form of the construction of the bubbling fluidized bed (BFB) enclosure.

Another design option may be used when a bubbling fluidized bed (BFB) enclosure 42 is adjacent to at least one furnace enclosure wall 16. FIG. 16 is another perspective view of a lower portion of the CFB chamber 12 illustrating such a construction of the bubbling fluidized bed (BFB) enclosure 42. Again, the enclosure walls 44 are made of refractory covered tubes 82; in this case, they penetrate through the furnace enclosure walls 16, and are provided with inlet header 86 and outlet header 88.

While specific embodiments of the invention have been shown and described in detail to illustrate the application of the principles of the invention, those skilled in the art will appreciate that changes may be made in the form of the invention covered by the following claims without departing from such principles. For example, the present invention may be applied to new construction involving circulating fluidized bed reactors or combustors, or to the replacement, repair or modification of existing circulating fluidized bed reactors or combustors. In some embodiments of the invention, certain features of the invention may sometimes be used to advantage without a corresponding use of the other features. Accordingly, all such changes and embodiments properly fall within the scope of the following claims.

We claim:

1. A circulating fluidized bed (CFB) boiler, comprising:

a CFB reaction chamber having side walls and a grid defining a floor at a lower end of the CFB reaction chamber for providing fluidizing gas into the CFB reaction chamber;

means for providing an amount of fluidizing gas to a first portion of the grid sufficient to produce a fast moving bed of fluidized solids in a first zone within the CFB reaction chamber, and means for providing an amount of fluidizing gas to a second portion of the grid sufficient to produce a bubbling fluidized bed (BFB) of fluidized solids in a second zone within the CFB reaction chamber, the amount of fluidizing gas provided to one zone being controllable independently of the amount of fluidizing gas provided to the other zone; and means for removing solids from the first and second zones for purging the solids from or recycling the solids to the CFB boiler.

2. The CFB boiler according to claim 1, comprising at least one bubbling fluidized bed enclosure defining the second zone within the CFB reaction chamber.

3. The CFB boiler according to claim 2, wherein the at least one bubbling fluidized bed enclosure is located within the CFB reaction chamber at one of approximately at a center thereof and adjacent a wall of the CFB reaction chamber.

4. The CFB boiler according to claim 2, comprising: first heating surface located within the bubbling fluidized bed enclosure to absorb heat from the bubbling fluidized bed of fluidized solids; and means for controlling heat transfer from the bubbling bed of fluidized solids to the first heating surface.

5. The CFB boiler according to claim 4, wherein the means for controlling heat transfer comprises one of means for controlling a bed level within the bubbling fluidized bed enclosure and controlling a throughput of solids through the bubbling fluidized bed enclosure.

6. The CFB boiler according to claim 4, wherein the means for controlling heat transfer comprise: one or more conduits for conveying solids particles from the bed and extending from a lower part of the bed just above the grid to an upper level at or above the lowest portion of the bubbling fluidized bed enclosure walls; and separate fluidization gas supply means below each of the one or more conduits to fluidize the solids particles in the associated conduit and cause them to be discharged from the bubbling fluidized bed into the surrounding fast moving bed of fluidized particles.

7. The CFB boiler according to claim 4, wherein the means for controlling heat transfer comprise: one or more non-mechanical valves for conveying solids particles from a lower part of the bubbling fluidized bed; and separate fluidization gas supply means in the vicinity of each of the one or more non-mechanical valves to fluidize the solids particles and cause them to be discharged from the lower part of the bubbling fluidized bed into the surrounding fast moving bed of fluidized particles.

8. The CFB boiler according to claim 1, comprising plural bubbling fluidized bed enclosures defining the second zone within the CFB reaction chamber.

9. The CFB boiler according to claim 4, wherein the plural bubbling fluidized bed enclosures are located within the CFB reaction chamber at both of approximately at a center thereof and adjacent a wall of the CFB reaction chamber.

10. The CFB boiler according to claim 1, comprising at least one bubbling fluidized bed enclosure defining the second zone within the CFB reaction chamber, the enclosure having walls extending upwardly from the floor, each enclosure wall being oriented one of vertical and inclined.

11. The CFB boiler according to claim 10, wherein the bubbling fluidized bed enclosure comprises fluid cooled tubes covered by erosion resistant material.

12. The CFB boiler according to claim 11, wherein the fluid cooled tubes form a division wall extending within the CFB reaction chamber and are connected to inlet and outlet headers located outside of the CFB reaction chamber.

13. The CFB boiler according to claim 1, comprising first heating surface located within the second zone to absorb heat from the bubbling fluidized bed of fluidized solids.

14. The CFB boiler according to claim 13, comprising at least one opening in the floor within the second portion of the grid, independently controllable fluidization gas supply means below the at least one opening, second heating surface located beneath the grid, and a path for solids to flow from the second zone to the second heating surface, wherein solids conveyed from the second zone and passing across the second heating surface are at least one of recycled to the CFB reaction chamber or purged.

15. The CFB boiler according to claim 14, comprising a third heating surface located interspersed within the fluidization gas supply means in the path from the second zone to the second heating surface, wherein solids conveyed from the second zone and passing across the third and the second heating surfaces are at least one of recycled to the CFB reaction chamber or purged.

16. The CFB boiler according to claim 15, wherein the first, second, and third heating surfaces comprise at least one of superheater, reheater, evaporative, and economizer surface.

17. The CFB boiler according to claim 1, comprising at least one opening in the floor within the second portion of the grid, independently controllable fluidization gas supply means below the at least one opening, and heating surface located beneath the grid within a path which conveys solids from the second zone out of the CFB reaction chamber.

18. The CFB boiler according to claim 17, wherein the heating surface is located below the independently controllable fluidization gas supply means.

19. The CFB boiler according to claim 17, wherein the heating surface is located interspersed within the independently controllable fluidization gas supply means.

20. A circulating fluidized bed (CFB) boiler, comprising: a CFB reaction chamber having side walls and a grid defining a floor at a lower end of the CFB reaction chamber for providing fluidizing gas into the CFB reaction chamber, the grid being partitioned into at least two zones each of which is supplied with separately controlled fluidization gas, the first zone within the reaction chamber being operated as a fast moving bed of fluidized particles, the second zone within the reaction chamber having a bubbling fluidized bed enclosure and being operated as a bubbling fluidized bed, and means for controlling heat transfer from the bubbling bed of fluidized solids to heating surface within the bubbling fluidized bed enclosure, said heating surface comprising at least one of superheater, reheater, evaporative, and economizer surface.

21. The CFB boiler according to claim 20, wherein the means for controlling heat transfer comprise means for controlling one of a bed level within the bubbling fluidized bed enclosure and a throughput of solids through the bubbling fluidized bed enclosure.

22. The CFB boiler according to claim 21, comprising: one or more conduits for conveying solids particles from the bubbling fluidized bed and extending from a lower part of the bed just above the grid to an upper level at or above the lowest portion of the bubbling fluidized bed enclosure; and separate fluidization gas supply means below each of the one or more conduits to fluidize the solids particles in the associated conduit and cause them to be discharged from the bubbling fluidized bed into the surrounding fast moving bed of fluidized particles.

23. The CFB boiler according to claim 21, comprising: one or more non-mechanical valves for conveying solids particles from a lower part of the bubbling fluidized bed; and separate fluidization gas supply means in the vicinity of each of the one or more non-mechanical valves to fluidize the solids particles and cause them to be discharged from the lower part of the bubbling fluidized bed into the surrounding fast moving bed of fluidized particles.

24. A circulating fluidized bed (CFB) boiler, comprising:

a CFB reaction chamber having side walls and a grid defining a floor at a lower end of the CFB reaction chamber for providing fluidizing gas into the CFB reaction chamber;

means for providing an amount of fluidizing gas to a first portion of the grid sufficient to produce a fast moving bed of fluidized solids in a first zone of the CFB reaction chamber;

at least one bubbling fluidized bed enclosure within the CFB reaction chamber defining a second zone and means for providing an amount of fluidizing gas to a second portion of the grid sufficient to produce a bubbling fluidized bed of fluidized solids in the second zone of the CFB reaction chamber, the amount of fluidizing gas provided to one zone being controllable independently of the amount of fluidizing gas provided to the other zone;

first heating surface located within the second zone to absorb heat from the bubbling fluidized bed of fluidized solids;

at least one opening in the floor within the second portion of the grid, independently controllable fluidization gas supply means below the at least one opening, second heating surface located beneath the grid, and a path for solids to flow from the second zone to the second heating surface; and a third heating surface located interspersed within the fluidization gas supply means in the path from the second zone to the second heating surface, the heating surfaces comprising at least one of superheater, reheater, evaporative, and economizer surface, and wherein solids conveyed from the second zone and passing across the third and the second heating surfaces are at least one of recycled to the CFB reaction chamber or purged.

* * * * *